US007464567B1

(12) United States Patent
Crossley et al.

(10) Patent No.: US 7,464,567 B1
(45) Date of Patent: Dec. 16, 2008

(54) APPARATUS FOR COOLING AND DISPENSING WINE

(76) Inventors: Rita J. Crossley, 604 School St., Sheridan, AR (US) 72150; William E. Crossley, 604 School St., Sheridan, AR (US) 72150

( * ) Notice: Subject to any disclaimer, the term of this patent is extended or adjusted under 35 U.S.C. 154(b) by 407 days.

(21) Appl. No.: 11/383,820

(22) Filed: May 17, 2006

Related U.S. Application Data

(60) Provisional application No. 60/681,856, filed on May 17, 2005.

(51) Int. Cl.
*F25D 3/08* (2006.01)

(52) U.S. Cl. ..... 62/457.8; 62/389; 220/345.1; 220/661; 220/676; 222/129; 222/146.6

(58) Field of Classification Search ..... 62/457.8, 62/457.2, 457.3, 457.4, 457.7, 371, 389; 222/129.1, 131, 146.6; 220/676, 661, 345.1; 312/265.5, 400
See application file for complete search history.

(56) References Cited

U.S. PATENT DOCUMENTS 2,827,927 A * 3/1958 Findlay ..... 177/52
3,934,758 A * 1/1976 Kipp ..... 222/108
5,358,326 A * 10/1994 Cherry et al. ..... 312/405
5,975,659 A * 11/1999 Yang et al. ..... 312/223.2
6,231,140 B1 * 5/2001 Chen ..... 312/223.2
6,481,239 B2 11/2002 Hodosh et al.
6,516,625 B2 * 2/2003 Bedard ..... 62/389
6,588,621 B2 7/2003 Shimazaki
6,626,005 B2 * 9/2003 Schroeder ..... 62/306
6,648,149 B2 * 11/2003 Robertson ..... 211/26
6,675,606 B1 1/2004 Jones et al.
D490,274 S 5/2004 Irvine
6,793,299 B2 * 9/2004 Newberry et al. ..... 312/199
D497,777 S 11/2004 Sanders et al.
6,912,867 B2 * 7/2005 Busick ..... 62/338
6,966,620 B2 * 11/2005 Lai ..... 312/223.3
7,013,667 B2 * 3/2006 Jung ..... 62/389
7,116,551 B2 * 10/2006 Erickson et al. ..... 361/685

* cited by examiner

*Primary Examiner*—Mohammad M Ali
(74) *Attorney, Agent, or Firm*—Crossley Patent Law; Mark A Crossley

(57) ABSTRACT

An apparatus for cooling and dispensing wine from a wine-filled bag of a prepackaged wine box, generally comprising an insulated parallelpiped box with molded handles, an upper front panel and a lower front panel with semi-circular notches forming a circle into which the wine tap for such wine-fulled may be locked into place for dispensing wine. One embodiment employs a cold or frozen freezable liquid pack placed on each side of the wine-filled bag, while another embodiment provides freezable, liquid-filled side, top, and rear panels. A drip reservoir is provided to prevent messy wine drippage. A name tag identifying the type of wine being dispensed may be placed into a nameplate slot centered on the upper front panel. The present apparatus may be made in a variety of colors and decorative exterior designs.

7 Claims, 7 Drawing Sheets

APPARATUS FOR COOLING AND DISPENSING WINE

FIELD OF INVENTION

The present apparatus related to insulated containers. More specifically, if relates to an insulated container designed to cool and dispense wine prepackaged in a box.

BACKGROUND OF THE INVENTION

In the past, resort has been made to using ice chests to cool wine. However, there are disadvantages to doing so. For example, because wine bottles are often larger than beverage cans, larger ice chests are typically needed, in which case they can be quite cumbersome to use. Moreover, it is particularly burdensome to use an ice chest if only a single bag of prepackaged wine must be cooled. In addition, wine contained in an opened wine bottle may easily spill in and ice chest. The current trend in the wine industry is to store and distribute wine in boxes, rather in wine bottles. The present apparatus is designed primarily for the purpose of cooling and dispensing wine contained in a bag from a conventional boxed wine.

Prior art teaches a variety of beverage cooler devices. For example, U.S. Pat. No. 6,675,606 issued Jan. 13, 2004 to Jones et al. teaches a cooler in combination with an ice pack and canteen wherein a container with a dispensing opening is partially filled with water, frozen and then placed in the cooler along with cooler contents. However, unlike the present apparatus, the cooler does not provide a beverage-dispensing or wine-dispensing feature.

U.S. Pat. No. 6,588,621 issued on Jul. 8, 2003 to Shimazaki provides a beverage bottle cooling method and apparatus with an assembly for holding ice and water comprising a container for ice and/or water that is adapted to have a commercial beverage bottle positioned therein, wherein such water and/or ice can be stored and seated with a space between the bottle and container to help keep the beverage inside cool. The present apparatus is different, however, because it is designed to cool and dispense wine packaged in a box, rather than in a bottle.

In addition to the foregoing patents. U.S. Pat. No. 6,481,239 issued Nov. 19, 2002 to Hodosh et al. teaches an insulated soft-side portable case having a receptacle positioned so that an object, such as a canned or bottled drink seats within the receptacle, and part extends outwardly so that a user can reach it which, in contrast to the present apparatus, could not accommodate wine packaged in a bag from a prepackaged boxed wine.

U.S. Pat. No. D497,777 issued Nov. 2, 2004 to Sanders et al. teaches an ornamental design of a combined wine cooler and ice bucker which is not designed to cool and dispense wine provided in a bag from prepackaged wine box as does the present apparatus.

U.S. Pat. No. D490,274 issued on May 25, 2004 to Irvine also teaches a wine cooler in the general shape of a large vase which is not designed to cool and dispense wine packaged in bag from a boxed wine as does the present apparatus.

What is needed is an apparatus to cool and dispense wine contained in a wine bag within wine distributed in boxes. The present apparatus addresses this need.

SUMMARY OF THE INVENTION

The general purpose of the present invention, described subsequently in greater detail, is to provide an apparatus for cooling and dispensing wine which is not anticipated, rendered obvious, suggested, or even implied by prior art, either alone or in combination thereof. In keeping with the current trend in the wine industry of storing and distributing wine in boxes, rather than in bottles, the present box-shaped insulated apparatus is designed to store and keep cool a bag of wine from a pre-packaged wine box. One embodiment of said apparatus comprises a single-walled insulated box formed of plastic polymer or other suitable light-weight materials used to insulate and keep wine cool and to dispense such wine. The insulation is provided in this embodiment, as well as in alternative embodiments, to reduce heat flow into the interior from the surroundings, thereby enabling a reduced temperature to be maintained within the apparatus. Another alternative embodiment of said apparatus may be comprised of a double-walled insulated box formed of plastic polymer or other suitable light-weight materials used to cool and dispense wine wherein said double walls are filled with airspace which is commonly known to provide further insulation. In either of the above-stated embodiments, a collapsible wine-filled bag is removal from a prepackaged box of wine and is placed into said apparatus. A cold or frozen Freeze Pak™ or similar item is placed on each side of said wine-filled bag inside said apparatus to keep wine cool. Yet another alternative embodiment of said apparatus features freezable, liquid-filled side and rear panels within said apparatus to cool wine, rather than a frozen Freeze Pak™ or similar item to cool wine. Alternative embodiments of said apparatus may display various decorative exterior designs. An important feature of the present apparatus for cooling and dispensing wine is a drip reservoir which lies beneath a wine tap to capture wine which may drip from the wine tap and to prevent wine from dripping on a surface below the apparatus. Often even after a wine tap is closed, wine drips from the wine tap. Said drip reservoir slides under the bottom panel of the present apparatus and rests upon a table top or other suitable location for dispensing wine from the apparatus. The drip reservoir may also be used with conventional boxed wines by sliding the drip reservoir underneath a boxed wine such that the drip reservoir sticks out to catch wine which may drip from the wine tap. There are, of course, additional features of said apparatus which will be described hereinafter. This apparatus overcomes the disadvantages of previous wine cooling methods and apparatuses.

An apparatus for cooling and dispensing wine that addresses the above disadvantages is needed. One advantage of the present apparatus over prior art is that it is uniquely designed for cooling and dispensing wine contained in plastic collapsible wine-filled bags from prepackaged wine boxes. This apparatus is also in concert with the new trend in the wine industry to store and market wine in boxes, rather than in glass wine bottles. This apparatus encourages the use of wine-filtered bags, rather than wine bottles, for storing wine, making it more environmentally friendly than prior art. Another advantage over prior art is that this apparatus is a light-weight and portable device uniquely designed for cooling and dispensing wine from a wine-filled bag. The distinctive wedge-shaped bottom of this apparatus is designed for gravity-flow of wine toward the wine tap, so that the apparatus does not need to be tipped toward the wine tap to empty the wine-filled bag. This wedge-shaped bottom design decreases the possibility of washing wine. Use of the unique drip reservoir of this apparatus is designed to prevent messy spills of wine such as when the wine tap is unknowingly left open or running or when wine is being dispensed into a glass held by an unsteady hand.

Those skilled in the art will appreciate that the conception upon which this disclosure is based may readily be utilized as a basis for the design of other structures, methods, and systems for carrying out the several purposes of the apparatus. It is therefore important that the description be regarded as including such equivalent constructions insofar as they do not depart form the spirit and scope of the present apparatus. Certain aspects of this apparatus may overcome one or more drawbacks of the previous art and/or advantage the state-of-the-art of coolers and, in addition, may meet one of more of the objects as stated hereinbelow.

It is, therefore, an object of the present apparatus for cooling and dispensing wine to cool a wine-filled bag from wine pre-packaged in a box more quickly than when cooling wine in a pre-packaged wine box.

Another object is to keep wine cool without electric refrigeration.

Yet another object of the present apparatus is to keep wine cool when exposed to a warm environment. With this apparatus, wine may be kept cool and dispensed outdoors—on a patio, on a picnic, on a boat, or in other locations—without the necessity of storing wine in a conventional refrigerator.

Still another object is to provide a light-weight and portable device to cool and dispense wine from wine-filled bag.

Even still another object is to provide an apparatus to cool and dispense wine from a wine-filled bag such apparatus having a wedge-shaped bottom for gravity flow of wine toward a wine tap so that the apparatus does not need to be tipped toward the wine tap to dispense wine.

Yet even another object is to provide a wine cooling and dispensing apparatus with a wedge-shaped bottom designed to prevent wasting wine which may be left in the bottom of a wine bag within a typical boxed wine.

Another object is to provide a wine cooling and dispensing apparatus which has a drip reservoir to capture wine which may drip from a wine tap to prevent messy spills of wine such as when a wine tap is left open, when a wine tap leaks after being closed, or when wine is being dispensed into a glass by an individual with an unsteady hand.

Thus has been broadly outlined the more important features of the invention so that the detailed description thereof that follows may be better understood and in order that the present contribution to the art may be better appreciated.

Numerous objects, features, and advantages of said apparatus will be readily apparent to those of ordinary skill in the art upon reading the following detailed description of presently preferred, but nonetheless illustrative, examples of the apparatus when taken in conjunction with the accompanying drawings. In this respect, before explaining the current examples of said apparatus in detail, it is to be understood that said apparatus is not limited in its application to the details of construction and arrangements of the components set forth in the following description or illustration. Said apparatus is capable of other examples and of being practiced and carried in various ways. It is also to be understood that the phraseology and terminology employed herein are for purposes of description and should be regarded as limiting.

BRIEF DESCRIPTION OF THE DRAWINGS

Figures

Figure 1:
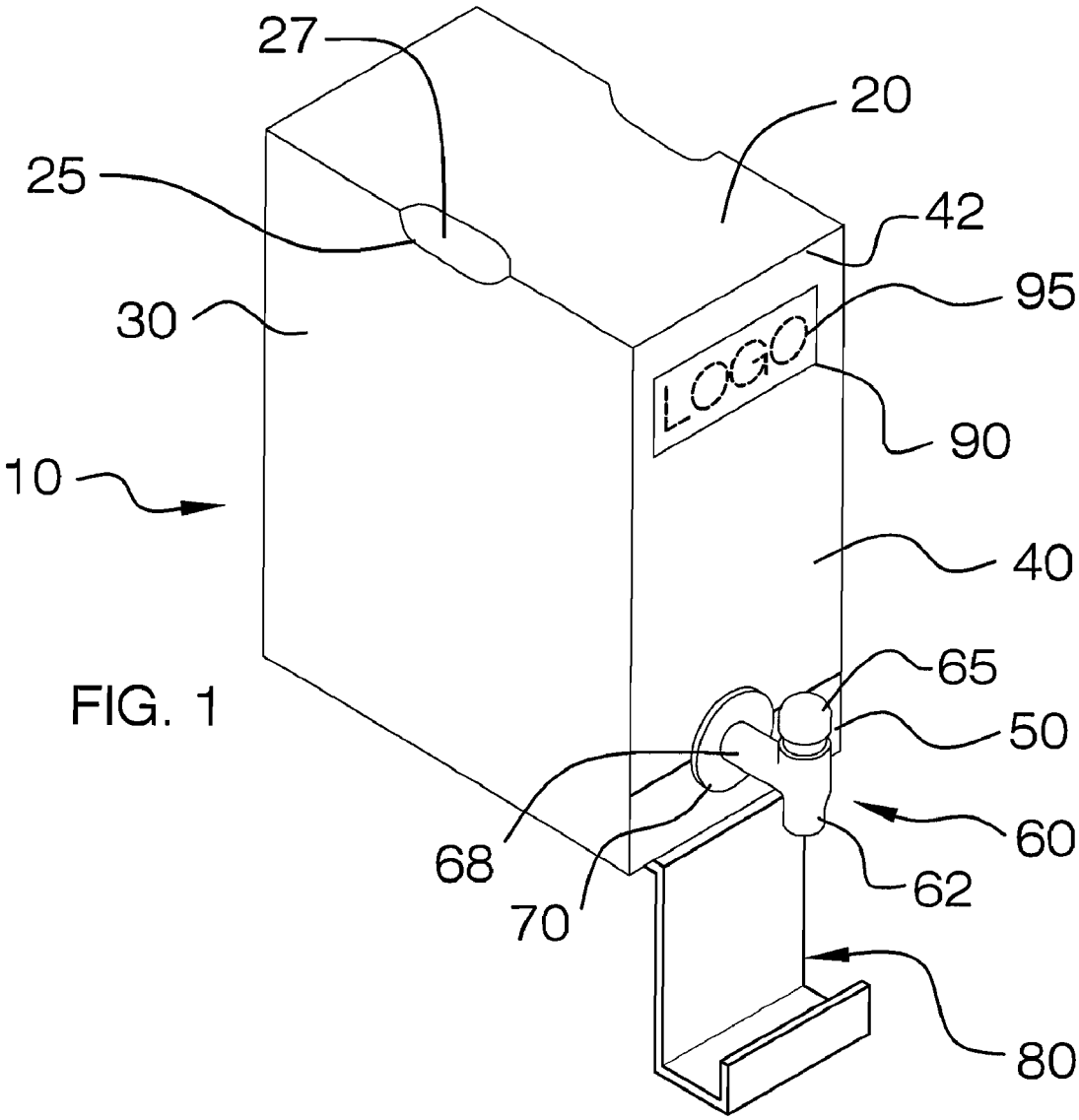
FIG. 1 is a left-side isometric view of apparatus.

REFERENCE NUMERALS:

10—Apparatus for Storing and Cooling Wine
20—Top panel
22—Front edge
23—Opening
25—Handle
27—Handle opening
30—Apparatus left side
40—Upper front panel
50—Lower front panel
51—Top edge
52—Turned up notch
53—Bottom edge
54—Turned down notch
60—Wine tap
62—Wine tap pouring piece
65—Wine tap upper piece
68—Wine tap rear piece
70—Exterior tap locking ring
78—Second right angle
80—Drip reservoir
81—First right angle
82—Drip reservoir top piece
83—Proximal end
84—Drip reservoir extension piece
85—Upper end
86—Drip reservoir receiver piece
87—Lower end
88—Drip reservoir front piece
89—Near end
90—Nameplate slot
91—Far end
95—Name tag
100—Side panel
102—Exterior side wall
104—Side wall mid-space
106—Interior side wall
110—Rear panel
112—Exterior rear wall
114—Mid-rear wall space
116—Interior rear wall
120—Side wall slots
130—Interior locking ring
140—Collapsible wine-filled bag
150—Bottom panel
151—Exterior edge
152—Interior edge
160—Table top

DETAILED DESCRIPTION OF THE DRAWINGS

Figure 2:
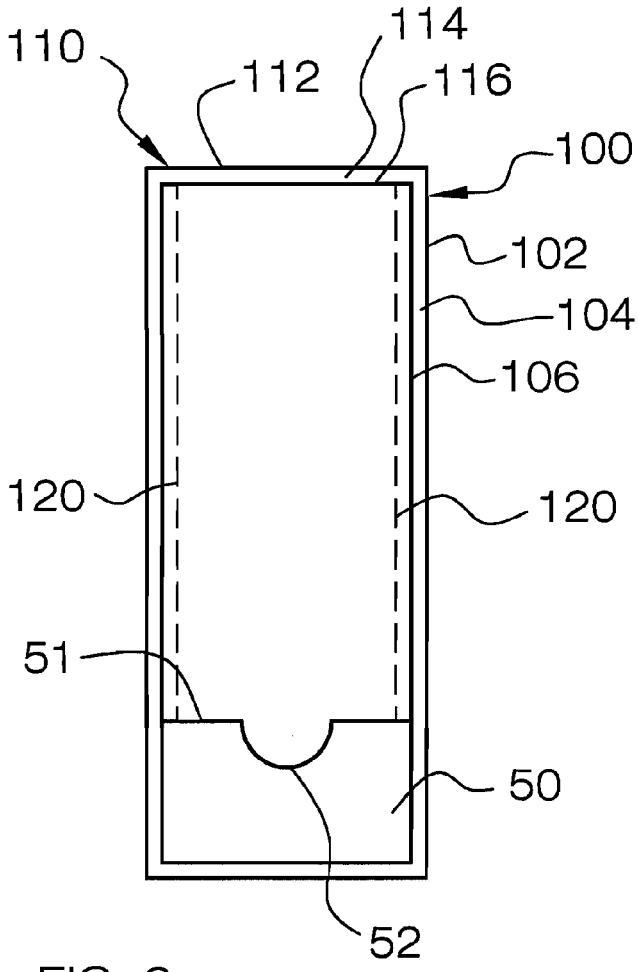
FIG. 2 is a front elevation view of apparatus shown with upper front panel removed.
Figure 3:
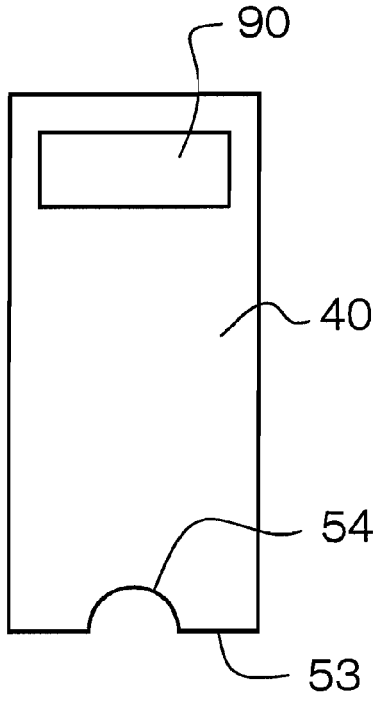
FIG. 3 is a front elevation view of upper front panel of apparatus.
Figure 4:
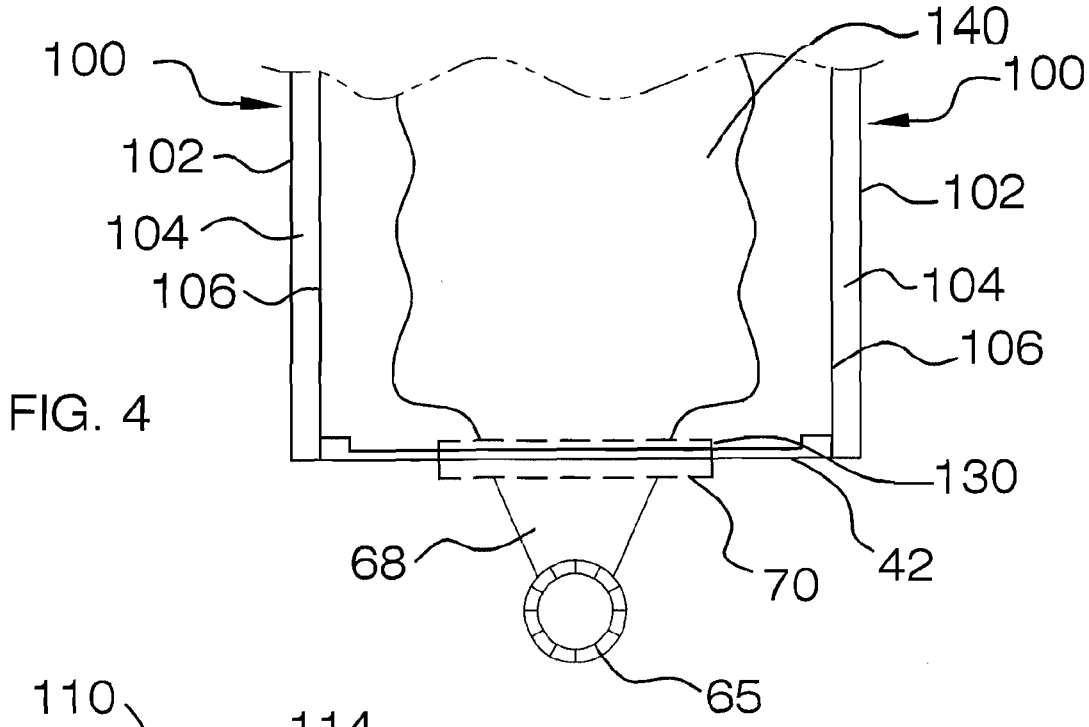
FIG. 4 is a top plan view of interior showing details of side panels and tap locking rings.
Figure 5:
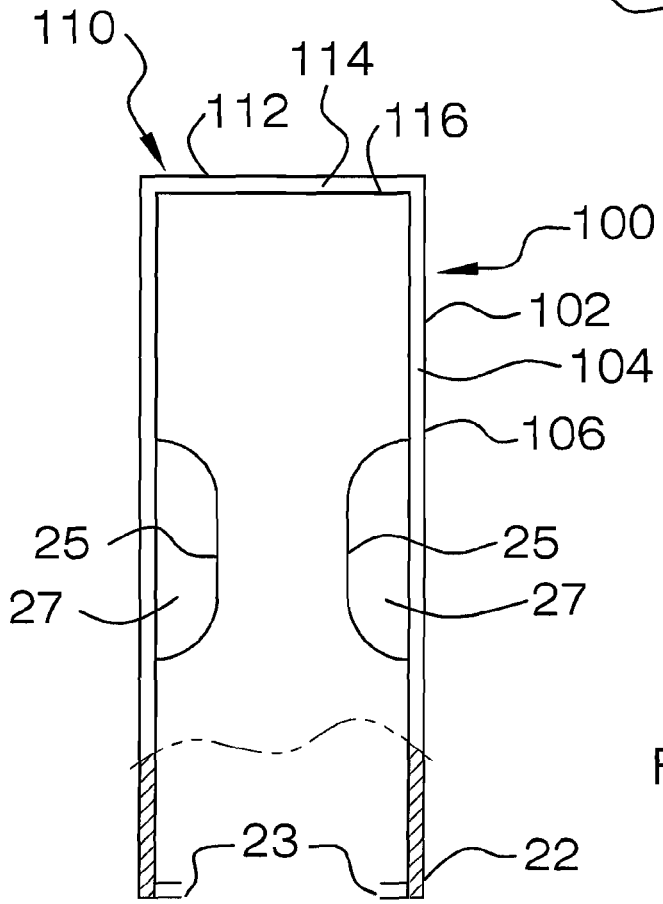
FIG. 5 is a top plan view of interior showing grooves for front panel and handle indentations.

With reference now to the drawings, and in particular FIGS. 1 through 9 thereof, the principles and concepts of the present apparatus generally designated by the reference number 10 will be described. dispensing wine 10. Said apparatus 10 is generally a rectangular parallepiped. Said apparatus 10 is formed of plastic polymer or other suitable light-weight materials which provide insulation for cooling. Said apparatus may be made in a wide variety of colors and decorative exterior designs. Said apparatus 10 comprises a top panel 20, two side panels 30, an upper front panel 40, a lower front panel 50, a rear panel 110, and a bottom panel 150 as shown in FIG. 1. Said top panel 20 comprises a generally flat rectangular-shaped panel with handles 25 on each side and handle openings 27 on each side as shown in FIG. 1 and FIG. 5. Said top panel 20 has an opening 23 centered on the front edge 22 of said top panel 20 as shown in FIG. 5. FIG. 1 shows said nameplate slot 90 displayed on said upper front panel 40 of said apparatus 10. A name tag 95 describing a type of wine being dispensed from said apparatus 10 is inserted into nameplate slot 90. Said upper front panel 40 may be inserted into side wall slots 120 located on the each side of each side panel 100, as shown in FIG. 2, in such a manner that the bottom edge 53 of said upper front panel 40 meets the lower front panel 50 in order to close said apparatus 10 as shown in FIG. 1 or raised up in said side wall slots 120 in such a manner as to open said apparatus 10 for insertion of a collapsible wine-filled bag 140.

FIG. 2 is a front view of said upper front panel 40. FIG. 2 shows a centered turned up notch 52 in the form of a semi-circle on the top edge 51 of said lower front panel 50. FIG. 3 is a front view of said upper front panel 40. FIG. 3 shows a centered turned down notch in the form of a semi-circle on the bottom edge 53 of said upper front panel 40. At the juncture of said upper front panel 40 and said lower front panel 50 is an exterior locking ring 70, as shown in FIGS. 1 and 4, and an interior locking ring 130, as shown in FIG. 4, into which the wine tap rear piece 68 (which is one component of a wine tap 60 of a collapsible wine-filled bag 140) is inserted and locked into place as shown in FIG. 4. Said wine tap 60 comprises wine tap pouring piece 62, as shown in FIG. 1, and a wine tap upper piece 65, and wine tap rear piece 68 as shown in FIG. 1 and FIG. 4.

Figure 6:
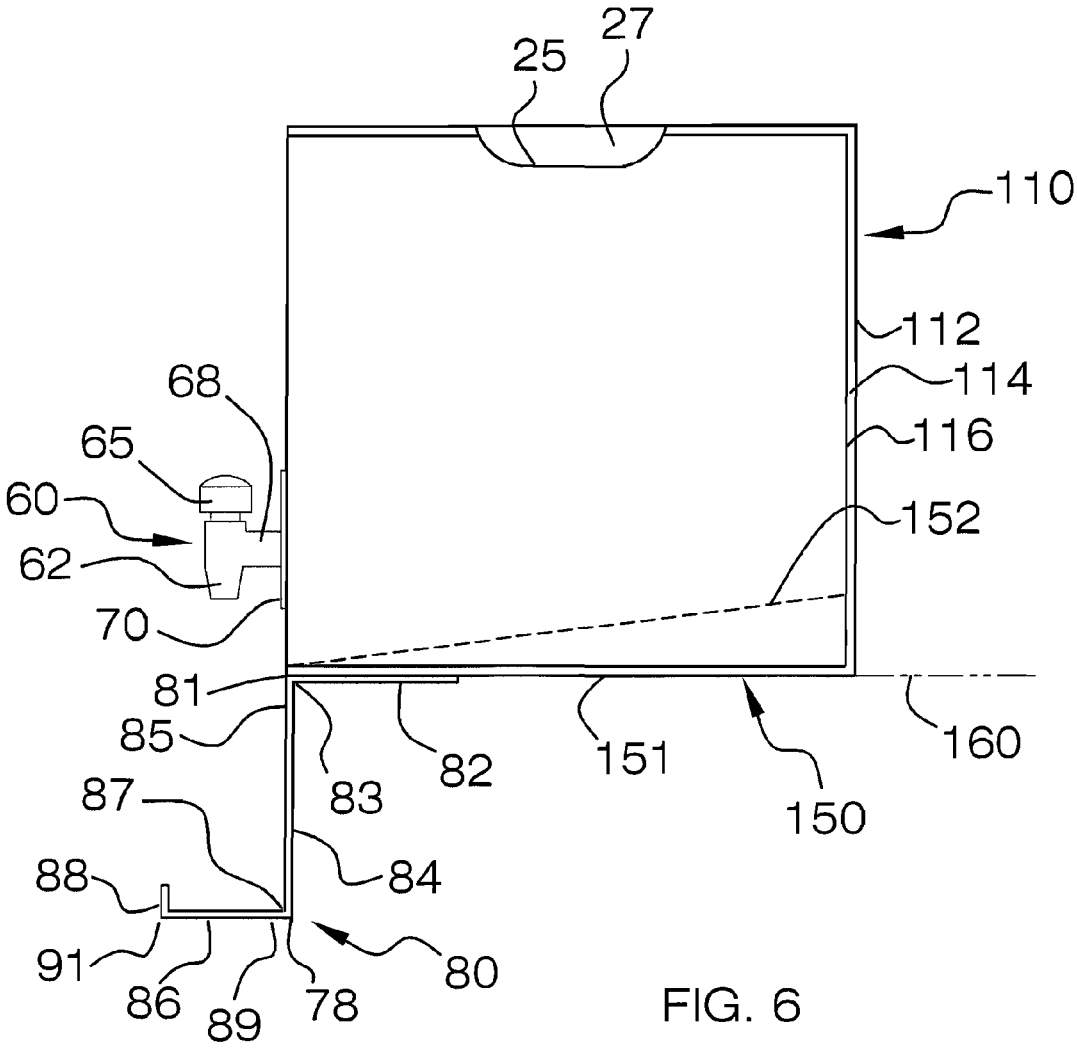
FIG. 6 is a side elevation view of apparatus.
Figure 9:
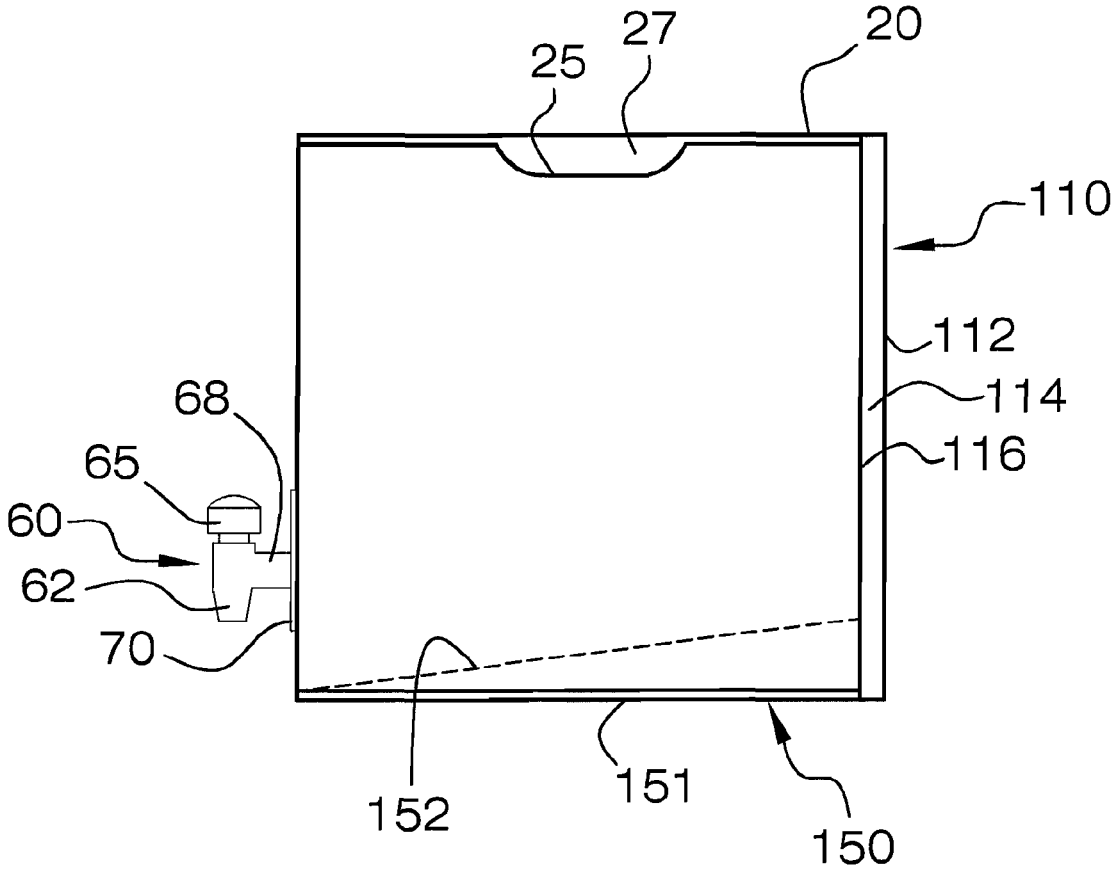
FIG. 9 is a side elevation view of alternative embodiment of apparatus with side panels and back panels designed to be liquid-filled.

FIG. 5 is a top plan view of two side panels 100, said rear panel 110, and said upper front panel 40. Each of said side panels 100 comprises an exterior side wall 102, a side wall mid-space 104 and an interior side wall 106, as shown in FIG. 5. Further, as shown in FIG. 5, said rear panel 110 comprises an exterior real wall 112, mid-rear wall space 114, and interior rear wall 116. Said bottom panel 150 is rectangular shaped on its exterior edge 151 and is wedge-shaped on its interior edge 152, as shown in FIGS. 6 and 9. The wedge-shaped interior edge 152 of bottom panel 150 encourages flow of wine toward wine tap 60.

Figure 7:
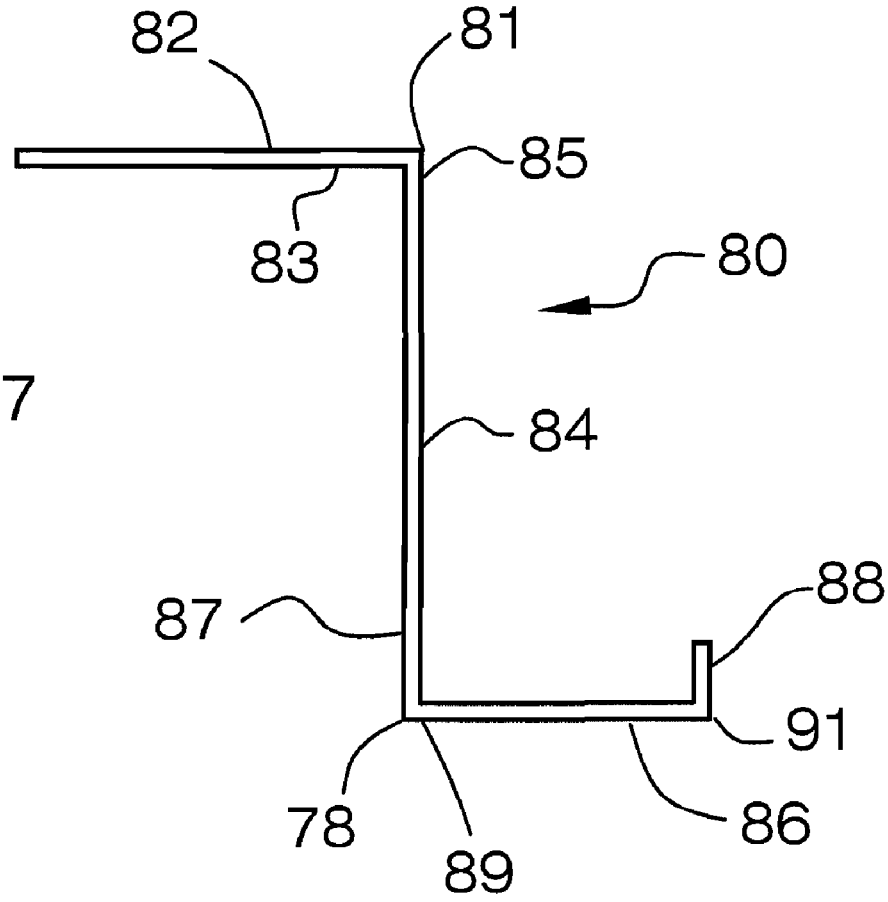
FIG. 7 is a side elevation view of drip reservoir.

FIG. 6 illustrates a molded handle 25 and handle opening 27 and said drip reservoir 80. Said drip reservoir 80 captures wine which may drip from said wine tap pouring piece 62. Said drip reservoir 80 comprises a drip reservoir top piece 82, a drip reservoir extension piece 84, a drip reservoir receiver piece 86, and a drip reservoir front piece 88 in a configuration shown in FIG. 6 and FIG. 7. Said drip reservoir top piece 82 is conjoined at its proximal end 83 to the upper end 85 of said drip reservoir extension piece 34 at a first ring angle 81. Said drip reservoir extension piece 34 is conjoined at its lower end 87 to the near end 89 of said drip reservoir receiver piece 86 at a second right angle 78 parallel to and in an opposite direction to said first right angle 81. Said drip reservoir front piece 88 is conjoined to said drip reservoir receiver piece 86 at a right angle which is parallel to said second right angle 78 and turned in the same direction as said second right angle 78 so that said drip reservoir front piece is pointing in an upwardly direction and so that said drip reservoir extension piece 84, said drip reservoir receiver piece 86 and said drip reservoir front piece 88 form a generally upwardly facing U-shape. Said drip reservoir top piece 82 slides under said bottom panel 150 so that said drip reservoir receiver piece 86 faces in an upwardly direction and said drip reservoir top piece 82 rests upon a table top 160, shown in broken lines, or other suitable location for dispensing wine from said apparatus 10 as shown in FIG. 6 and FIG. 7. The broken lines shown in FIG. 6 are for illustrative purposes only and form no part of the claims for the present apparatus 10.

FIG. 7 illustrates said drip reservoir 80. Said drip reservoir 80 captures wine which may drip from said wine tap pouring piece 62. Said drip reservoir 80 comprises a drip reservoir top piece 82, a drip reservoir extension piece 84, a drip reservoir receiver piece 86, and a drip reservoir front piece 88 in a configuration shown in FIG. 6 and FIG. 7. Said drip reservoir top piece 82 is conjoined at its proximal end 83 to the upper end 85 of said drip reservoir extension piece 34 at a first right angle 81. Said drip reservoir extension piece 34 is conjoined at its lower end 87 to the near end 89 of said drip reservoir receiver piece 86 at a second right angle 78 parallel to and in an opposite direction to said first ring angle 81. Said drip reservoir front piece 88 is conjoined to said drip reservoir receiver piece 86 at a right angle which is parallel to said second ring angle 78 and turned in the same direction as said second right angle 76 so that said rip reservoir front piece is pointing in an upwardly direction and so that said drip reservoir extension piece 84, and drip reservoir receiver piece 86 and said drip reservoir front piece 88 form a generally upwardly facing U-shaped. Said drip reservoir top piece 82 slides under said bottom panel 150 so that said drip reservoir receiver piece 80 faces in an upwardly direction and said drip reservoir top piece 82 rests upon a table top 160 or other suitable location for dispensing wine from said apparatus 10 as shown in FIG. 6. The broken lines illustrates a level of drips of wine which can be held by the drip reservoir and are shown for illustrative purposes only and form no part of the claims for the present apparatus 10. Said drip reservoir 80 may be formed of molded plastic, metal, or other materials suitable for capturing liquid, such as wine. A preferred embodiment of said drip reservoir 80 generally has a drip reservoir top piece 82 approximately 9 cm in length, a drip reservoir extension piece 84 approximately 9 cm in length, a drip reservoir receiver piece 86 approximately 4 cm in length, and a drip reservoir front piece 88 approximately 1 cm in length. However, the length of these components of said drip reservoir 80 may be formed of other lengths so that the drip reservoir 80 properly balances on a table top or other surface suitable upon which to place the present apparatus 10, does not tip over such apparatus 10, and is formed so as to have the capability of capturing drips of wine.

Figure 8:
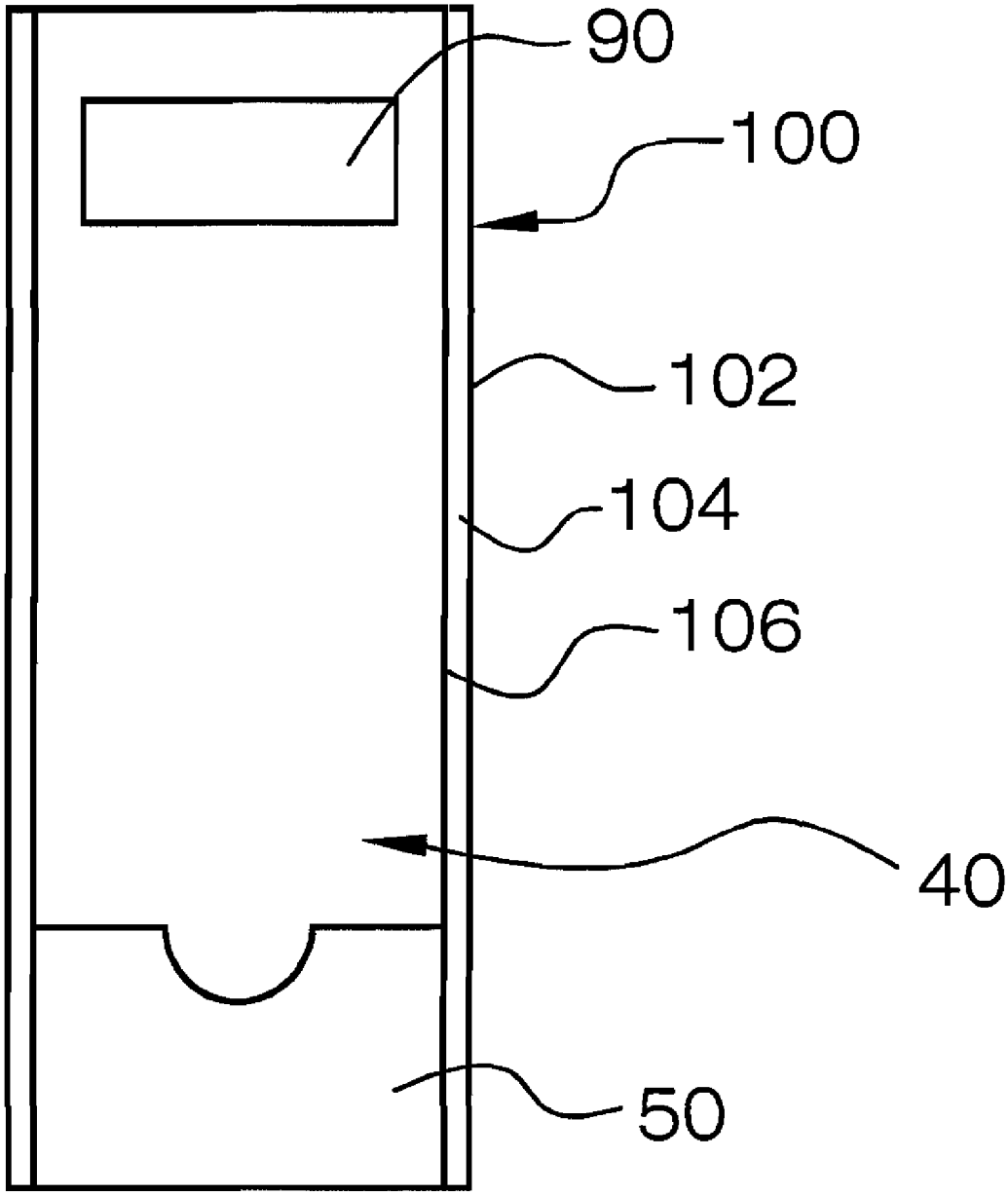
FIG. 8 is a front elevation view of alternate embodiment of apparatus with side panels and back panels designed to be liquid-filled.

FIG. 8 illustrates an alternative embodiment of the present apparatus 10 which employs side panels 100 and rear panel 110 (shown in FIG. 9) filled with freezable liquid. As shown in FIG. 8, each side panel 100 is filled with freezable liquid located in said side wall mid-space 104 located between said exterior side wall 102 and interior side wall 106. A nameplate slot 90 appears centered at the top of an upper front panel 40, while a lower front panel 50 rests below said upper front panel as shown in FIG. 2. Such alternative embodiment allows the present apparatus 10 to be placed in a freezer and frozen prior to placing a bag filled with wine from a prepackaged wine box inside the present apparatus 10 for faster cooling and longer cooling time period.

FIG. 9 is a side elevation view of an alternative embodiment of the present apparatus 10 comprising a liquid-filled rear panel 110, an air-filled double walled top panel 20, and an air-filled double walled bottom panel 150. A mid-rear wall space 114, located between an exterior real wall 112 and an interior rear wall 116, is filled with freezable liquid to provide for quicker cooling time and longer cooling period.

Operation:

The present apparatus 10 is designed to use with a collapsible wine-filled bag 140 (as shown in FIG. 4) from a prepackaged box of wine. The first step is to manually tear apart the top flaps of a prepackaged box of wine, without using sharp objects so as to avoid puncturing the plastic collapsible wine-filled bag 140 (shown in FIG. 4) stored inside the prepackaged box of wine. Next, remove the plastic collapsible wine-filled bag 140 (shown in FIG. 4) from the prepackaged box of wine. Remove upper front panel 40 (shown in FIG. 1 and FIG. 3) from apparatus 10 by sliding upper front panel 40 upward and out of top panel 20 (shown in FIG. 1). Set aside upper front panel 40 for later use.

Place said apparatus 10 on a flat surface, such as a countertop or table top 160 (as shown in FIG. 6), with rear panel 110 (shown in FIG. 5) facing downwardly on the surface and lower front panel 50 (shown in FIG. 1 and FIG. 2) facing upwardly. Insert one frozen liquid pack, such as a Freeze Pak™, flat down against rear panel 110.

Insert plastic collapsible wine-filled bag 140 into center interior of apparatus 10 with wine tap 60 facing toward the lower front panel 50. As shown in FIG. 4, insert wine tap rear piece 68 through interior locking ring 130 and through exterior locking ring 70 and fit wine tap 60 in to the semi-circular turned up notch 52 of lower front panel 50 with wine tap upper piece 65 facing up and wine tap pouring piece 62 facing downwardly.

Insert another frozen liquid pack, such as a Freeze Pak™, against top panel 20 (toward the back of the collapsible wine-filled bag 140, on the opposite end from the wine tap 60).

Replace said upper front panel 40, with nameplate slot 90 facing outwardly, by inserting a bottom edge 53 of said upper front panel 40 into slot wall slots 120. Continue to slide in upper front panel 40 into position until it comes to a rest against said lower front panel 50. Wine tap 60 will then be locked in place. Position apparatus 10 in an upright position with top panel 20 facing up and wine tap 60 facing down (as shown in FIG. 1).

A name tag 95 identifying the type of wine being dispensed from apparatus 10 may be placed into the nameplate slot 90 (shown in FIG. 1) located on upper front panel 40.

Referring to FIG. 1, FIG. 6, and FIG. 7, a drip reservoir 80, with drip reservoir receiver piece 86 facing up, may be placed underneath apparatus 10 by sliding drip reservoir top piece 82 between bottom panel 150 and surface upon which apparatus 10 rests (such as a countertop or table).

Alternative Embodiments:

An alternate embodiment of apparatus 10, utilizes a singe-walled, rather than a double-walled, insulated box made of plastic polymer or other suitable light—weight material.

With respect to the above description then, it is to be realized that the optimum dimensional relationships for the parts of the present apparatus for cooling and dispensing wine, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present apparatus.

Directional terms such as "front", "back", "in", "out", "downward", "upper", "lower", and the like may have been in the description. These terms are applicable to the examples shown and described in conjunction with the drawings. These terms are merely used for the purpose of description in connection with the drawings and do not necessary apply to the position in which the present apparatus may be used.

Therefore, the foregoing is considered as illustrative only of the principles of the apparatus. Further, since numerous modifications and changes will readily occur to those skilled in the art, it is not desired to limit the apparatus to the exact construction and operation shown and described, and accordingly, all suitable modifications and equivalents may be resorted to, falling within the scope of the apparatus.

What is claimed is:

1. An apparatus for cooling and dispensing wine comprising:

a generally parallelepiped box further comprising
- a top panel;
- a side panel on each side of said top panel, said side panel further comprising:
- an exterior side wall;
- a side wall mid-space; and
- an interior side wall;
- a side wall slot located on the front panel;
- an upper front panel;
- the upper front panel is disposed in the slot;
- a lower front panel;
- a rear panel further comprising:
  - an exterior real wall;
  - mid-rear wall space; and
  - interior rear wall;
- a bottom panel, said bottom panel being wedge-shaped on an interior edge;
- a handle on each side panel;
- an opening centered on a front edge of said front panel;
- a semi-circular turned up notch centered on a top edge of said lower front panel;
- a semi-circular turned down notch centered on a bottom edge of said upper front panel;
- an exterior locking ring located at a juncture of said upper front panel and said lower front panel;
- an interior locking ring located on the inside of said apparatus at a juncture of said upper and front panel and said lower front panel a wine tap further comprising:
- wine tap pouring piece;
- a wine tap upper piece; and
- a wine tap rear piece; and a drip reservoir further comprising:
- a drip reservoir top piece;
- a drip reservoir extension piece;
- a drip reservoir receiver piece; and
- a drip reservoir front piece.

2. The apparatus for cooling and dispensing wine of claim 1 further comprising a nameplate slot located on said upper front panel.

3. The apparatus for cooling and dispensing wine of claim 1 further comprising:
- a drip reservoir top piece approximately 9 cm in length;
- a drip reservoir extension piece approximately 9 cm in length;
- a drip reservoir receiver piece approximately 4 cm in length; and
- a drip reservoir front piece approximately 1 cm in length.

4. The apparatus for cooling and dispensing wine of claim 1 wherein each side panel and said rear panel are filled with freezable liquid.

5. An apparatus for cooling and dispensing wine comprising:

a generally parallelpiped box further comprising
a double-walled top panel;
a side panel on each side of said top panel, said side panel further comprising:
an exterior side wall;
a side wall mid-space; and
an interior side wall;
a side wall slot located on the front panel;
an upper front panel;
the upper front panel is disposed in the slot;
a lower front panel;
a rear panel further comprising:
an exterior real wall;
mid-rear wall space filled with freezable liquid;
interior rear wall;
a double-walled bottom panel, said bottom panel being wedge-shaped on an interior edge;
a handle on each side panel;
an opening centered on a front edge of said top panel;
a semi-circular turned up notch centered on a top edge of said lower front panel;
a semi-circular turned down notch centered on a bottom edge of said upper front panel;
an exterior locking ring located at a juncture of said upper front panel and said lower front panel;
an interior locking ring located on the inside of said apparatus at a juncture of said upper front panel and said lower front panel
a wine tap further comprising:
wine tap pouring piece;
a wine tap upper piece; and
a wine tap rear piece; and
a drip reservoir further comprising:
a drip reservoir top piece;
a drip reservoir extension piece;
a drip reservoir receiver piece; and
a drip reservoir front piece.

6. A method of cooling and dispensing wine comprising steps of:
removing a wine-filled bag from a prepackaged box of wine;
sliding an upper front panel upwardly and removing said upper front panel of said an apparatus for cooling and dispensing wine;
placing said apparatus on a flat surface with rear panel facing downwardly on the surface and lower front panel facing upwardly;
inserting one frozen liquid pack flat against rear panel;
inserting said wine-filled bag into apparatus with wine tap facing toward the lower front panel;
inserting wine tap rear piece through interior locking ring and through exterior locking ring;
fitting said wine tap into a semi-circular turned up notch of lower front panel with wine tap upper piece facing up and wine tap pouring piece facing downwardly;
inserting another frozen liquid pack against said front panel and toward the back of the wine-filled bag, on the opposite end from the wine tap;
replacing said upper front panel with nameplate slot facing outwardly, by inserting a bottom edge of said upper front panel into a slot located on the front panel;
continuing to slide in upper front panel into position until said upper front panel comes to a rest against lower front panel, thus locking said wine tap in place;
positioning apparatus in an upright position with top panel facing up and wine tap facing downwardly; and
sliding a drip reservoir top piece between a bottom panel of said apparatus and surface upon which apparatus rests.

7. The method of cooling and dispensing wine of claim 6 further comprising a step of:
writing the type of wine being dispensed on a name tag; and
placing said name tag into said nameplate slot.

* * * * *